US007541732B2

(12) United States Patent
Ahn

(10) Patent No.: US 7,541,732 B2
(45) Date of Patent: Jun. 2, 2009

(54) ELECTRON EMISSION WITH ELECTRON EMISSION REGIONS ON CATHODE ELECTRODES

(75) Inventor: Sang-Hyuck Ahn, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 693 days.

(21) Appl. No.: 11/066,855

(22) Filed: Feb. 24, 2005

(65) Prior Publication Data

US 2005/0184634 A1 Aug. 25, 2005

(30) Foreign Application Priority Data

Feb. 25, 2004 (KR) ..... 10-2004-0012628

(51) Int. Cl.
*H01J 1/62* (2006.01)

(52) U.S. Cl. ..... 313/497; 313/311

(58) Field of Classification Search ..... 313/495–497, 313/294, 306, 309–311, 351, 346 R, 336
See application file for complete search history.

(56) References Cited

U.S. PATENT DOCUMENTS 6,028,391 A * 2/2000 Makishima ..... 313/310
7,115,013 B2 * 10/2006 Liu et al. ..... 445/50
7,382,090 B2 * 6/2008 Park et al. ..... 313/497
2003/0141798 A1 * 7/2003 Jin et al. ..... 313/310
2004/0012327 A1 * 1/2004 Shiratori et al. ..... 313/497
2005/0184634 A1 * 8/2005 Ahn ..... 313/311
2005/0258739 A1 * 11/2005 Park et al. ..... 313/497

FOREIGN PATENT DOCUMENTS

CN 1102797 C 3/2003
EP 0 686 991 A1 12/1995
WO WO 00/52726 9/2000

* cited by examiner

*Primary Examiner*—Peter Macchiarolo
(74) *Attorney, Agent, or Firm*—Christie, Parker & Hale, LLP

(57) ABSTRACT

An electron emission device includes components for inhibiting the diffusion of electron beams, decreasing the light emission of incorrect colors, and preventing the diode type electron emission due to the anode electric field. In particular, the electron emission device includes a substrate with grooves, and electron emission regions filling the grooves. Cathode electrodes are provided at the substrate such that the cathode electrodes are electrically connected to the electron emission regions. Gate electrodes are formed over the cathode electrodes while interposing an insulating layer.

12 Claims, 5 Drawing Sheets

ELECTRON EMISSION WITH ELECTRON EMISSION REGIONS ON CATHODE ELECTRODES

CROSS REFERENCE TO RELATED APPLICATION

This application claims priority to and the benefit of Korean Patent Application No. 10-2004-0012628 filed on Feb. 25, 2004 in the Korean Intellectual Property Office, the entire content of which is incorporated herein by reference.

BACKGROUND OF THE INVENTION

1. Field of the Invention

The present invention relates to an electron emission device, and in particular, to an electron emission device which has electron emission regions (or sources) formed with a material for emitting electrons when applied with an electric field under a vacuum atmosphere, and a method of fabricating the same.

2. Description of Related Art

Generally, the electron emission devices can be classified into two types. A first type uses a hot (or thermoionic) cathode as an electron emission source, and a second type uses a cold cathode as an electron emission source.

Also, in the second type of electron emission devices, there are a field emitter array (FEA) type, a surface conduction emitter (SCE) type, a metal-insulator-metal (MIM) type, and a metal-insulator-semiconductor (MIS) type.

The FEA type electron emission device is based on the principle that when a material having a low work function or a high aspect ratio is used as the electron emission source, electrons are easily emitted from the material in a vacuum atmosphere due to an electric field. A sharp-pointed tip structure based on molybdenum (Mo) or silicon (Si), or a carbonaceous material, such as carbon nanotube, graphite and/or diamond-like carbon, has been developed to be used as the electron emission source.

In an exemplary FEA type electron emission device, cathode electrodes and an insulating layer are formed on a substrate, and gate electrodes are formed on the insulating layer while crossing the cathode electrodes. Opening portions are formed at the gate electrodes and the insulating layer per the crossed regions thereof to partially expose the surface of the cathode electrodes, and electron emission regions are formed on the cathode electrodes within the opening portions.

The insulating layer can be formed through paste printing such that it has a thickness of 5 μm or more. A mask layer can be formed on the gate electrodes, and the gate electrodes and the insulating layer can then be wet-etched to form opening portions thereat.

However, when the wet etching is used to form opening portions at the insulating layer, the so-called under-cut phenomenon is generated at the portion of the insulating layer opposite to the etching initiation point thereof due to the etching isotropy, in which the opening width is narrowed as compared to that at the etching initiation point. For this reason, the bottom-sided etching width is smaller than the top-sided etching width with the openings of the insulating layer, and hence, the exposure area of the cathode electrodes to be formed with electron emission regions is reduced.

Accordingly, with the above-structured electron emission device, it is difficult to form micro pixels and fabricate a high resolution display device, and as the amount of the electron emission material to be given on the cathode electrodes is relatively small, it is also difficult to obtain a high luminance display screen.

In order to solve the above problem, an insulating layer can be formed with $SiO_2$ through chemical vapor deposition (CVD) such that it has a thickness of 1-3 μm. However, in this case, as the electron emission regions are formed with a thickness of 2-5 μm due to the characteristic of the thick film processing, such as screen printing, the electron emission regions may be placed higher than the gate electrodes. Consequently, the electrons emitted from the electron emission regions are not focused and/or influenced by the gate electrodes and thereby cause a considerable diffusion of electron beams and/or a diode type electron emission where electrons are mistakenly emitted from the electron emission regions at the pixels to be off-stated due to the influence of the anode electric field.

SUMMARY OF THE INVENTION

In an aspect of the present invention, an electron emission device inhibits the diffusion of electron beams to prevent the incorrect colors from being light-emitted, and minimizes the diode type emission of electrons.

In an exemplary embodiment of the present invention, the electron emission device includes a substrate having grooves, and electron emission regions formed into the grooves. Cathode electrodes are formed on the substrate such that they are electrically connected to the electron emission regions. Gate electrodes are formed over the cathode electrodes and an insulation layer is located between the cathode electrodes and the gate electrodes.

The cathode electrodes may be formed with a metallic material selected from chromium (Cr), aluminum (Al), and/or molybdenum (Mo) materials. The cathode electrodes may be placed over the grooves with opening portions corresponding thereto. The height difference between the top surface of the electron emission region and the surface of the cathode electrode may be 1 μm or less.

The cathode electrodes may be formed on a top surface of the substrate and an inner wall of the grooves and/or with a transparent conductive material. A resistance layer or a non-transparent metallic layer may be formed on a top surface of the cathode electrodes that is not located in an inner surface of the grooves.

The grooves may have a depth of about 2-3 μm, and the electron emission regions are formed with a material selected from carbon nanotube, graphite, graphite nanofiber, diamond, diamond-like carbon, $C_{60}$, and/or silicon nanowire materials.

In an exemplary embodiment of the present invention, a method of fabricating the electron emission device is provided. The method includes cathode electrodes that are formed on the substrate such that they have first opening portions. Portions of the substrate exposed through the first opening portions are etched to form grooves. An insulating layer and gate electrodes are formed on the cathode electrodes such that they have respective second and third opening portions corresponding to the grooves. Electron emission regions are formed within the grooves and the first opening portions of the cathode electrodes by filling them with an electron emission material.

In an exemplary embodiment of the present invention, a method of fabricating an electron emission device is provided. The method includes a substrate that is partially etched to form grooves. A transparent electrode material is coated onto a surface of the substrate including an inner wall of the grooves to form cathode electrodes. An insulating layer and gate electrodes are formed on the cathode electrodes such that they have respective first and second opening portions corresponding to the grooves. Electron emission regions are formed over the cathode electrodes within the inner wall of the grooves with an electron emission material.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
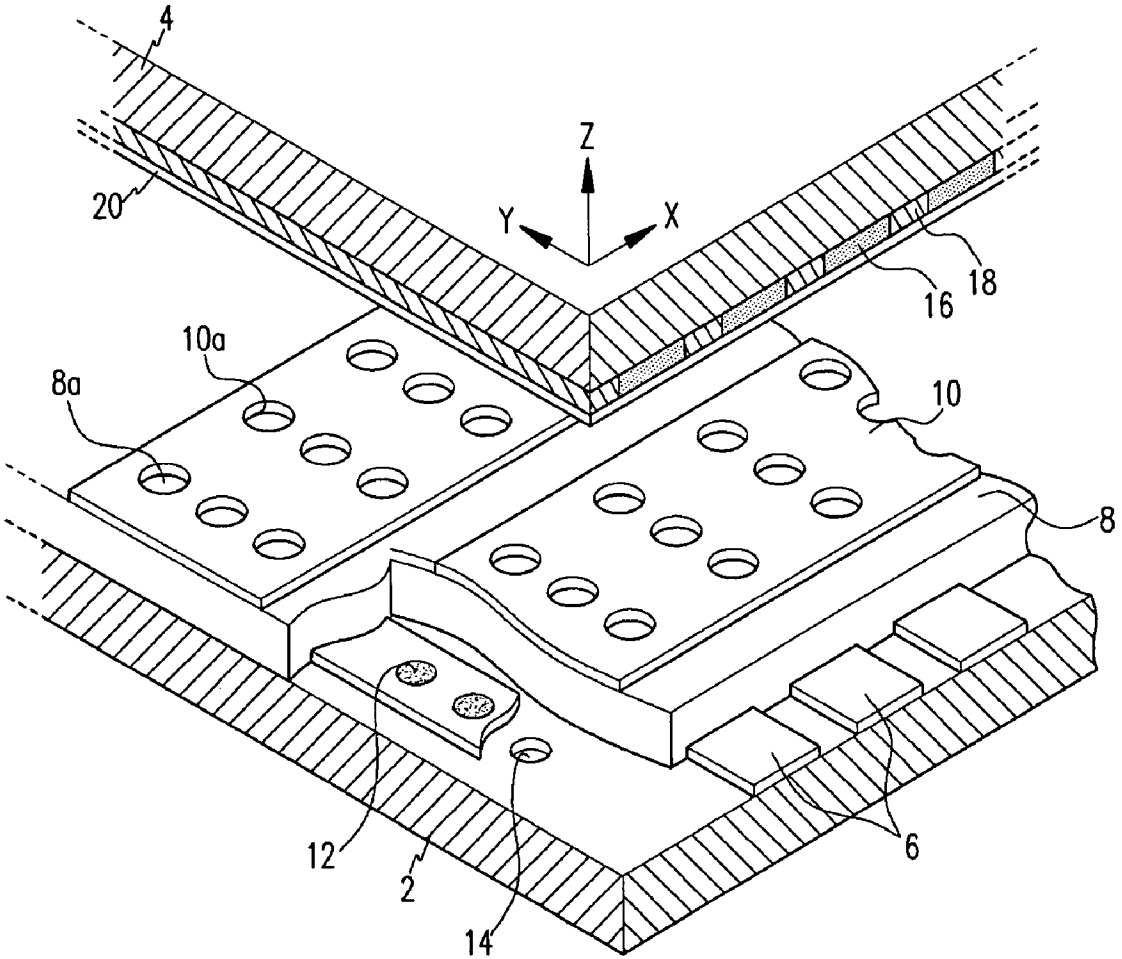
FIG. 1 is a partial exploded perspective view of an electron emission device according to a first embodiment of the present invention.
Figure 2:
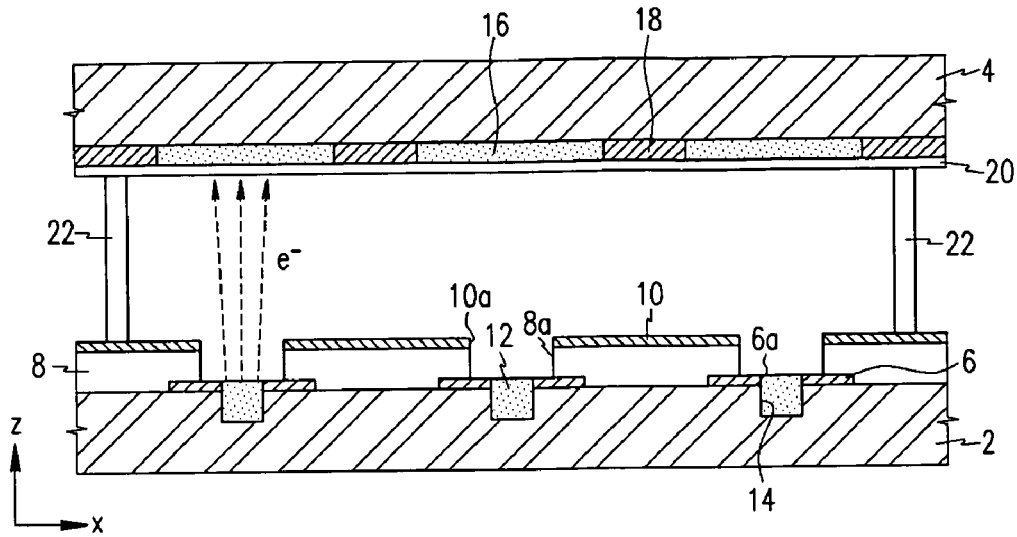
FIG. 2 is a partial sectional view of the electron emission device according to the first embodiment of the present invention.

As shown in FIGS. 1 and 2, the electron emission device of the first embodiment includes first and second substrates 2 and 4 facing each other with an inner space. An electron emission structure is provided at the first substrate 2 to emit electrons, and a light emission or display structure is provided at the second substrate 4 to emit visible rays due to the electrons.

Specifically, cathode electrodes 6 are stripe-patterned on the first substrate 2 in a first direction (e.g., in a y-axis direction of FIG. 1). An insulating layer 8 is formed on the entire surface of the first substrate 2 by depositing $SiO_2$ onto the first substrate 2 through CVD such that the insulating layer 8 covers the cathode electrodes 6. The insulating layer 8 has a thickness of about 1-3 μm. Gate electrodes 10 are stripe-patterned on the insulating layer 8 in a second direction crossing the cathode electrodes 6 (e.g., in an x-axis direction of FIG. 1).

In the present invention, the technique of forming the insulating layer 8 and the thickness of the insulating layer 8 are provided for exemplary purposes and the present invention is not limited to the above described technique and/or thickness.

When the crossed regions of the cathode and the gate electrodes 6 and 10 are defined as the pixel regions, at least one opening portion 8*a* is formed at the insulating layer 8 and at least one opening portion 10*a* is formed at the gate electrode 10 for the respective pixel regions. Electron emission regions 12 are formed within the opening portions 8*a* and 10*a* while being electrically connected to the cathode electrodes 6.

In the first embodiment, to solve the problem of having the insulating layer 8 being a thin thickness of about 3 μm, the portions of the first substrate 2 to be formed with electron emission regions 12 are each etched with a depth of about 2-3 μm to thereby form grooves 14, and portions of the electron emission regions 12 are formed within the grooves 14.

Opening portions 6*a* (as shown in FIG. 2) are formed at the cathode electrodes 6 corresponding to the grooves 14, and the electron emission regions 12 simultaneously fill the grooves 14 of the first substrate 2 and the opening portions 6*a* of the cathode electrodes 6 such that they contact the lateral sides of the cathode electrodes 6.

The electron emission regions 12 are formed with a material for emitting electrons under the application of an electric field, such as a carbonaceous material and/or a nanometer-sized material. In one embodiment, the electron emission regions 12 are formed using carbon nanotube, graphite, graphite nanofiber, diamond, diamond-like carbon, $C_{60}$, and/or silicon nanowire materials.

Phosphor layers 16 and black layers 18 are formed on the surface of the second substrate 4 facing the first substrate 2. An anode electrode 20 is formed on the phosphor layers 16 and the black layers 18 with a metallic material, such as aluminum. The anode electrode 20 receives a high voltage required for accelerating the electron beams toward the phosphor layers 16. In addition, the anode electrode 20 reflects the visible rays radiated toward the first substrate 2 to the second substrate 4 to thereby further heighten the screen luminance.

Alternatively, the anode electrode may be formed with a transparent conductive material, such as indium tin oxide (ITO). In this case, the anode electrode (not shown) is formed on the surface of the phosphor and the black layers facing the second substrate. The anode electrode may be formed on the entire surface of the second substrate, or partitioned into a plurality of portions with a predetermined pattern.

Referring still to FIGS. 1 and 2, spacers 22 are arranged between the first and the second substrates 2 and 4, and the first and the second substrates 2 and 4 are attached to each other at their peripheries using a glass or seal frit with a low melting point. The inner space between the first and the second substrates 2 and 4 is exhausted to be in a vacuum state to thereby construct an electron emission device. The spacers 22 are arranged in correspondence with the non-luminescence regions where the black layers 18 are placed. In addition, a mesh-type grid electrode (not shown) may be disposed between the first and the second substrates 2 and 4 to focus the electron beams.

The above-structured electron emission device is driven by applying predetermined voltages to the cathode electrodes 6, the gate electrodes 10, and the anode electrode 20. For instance, driving voltages with a voltage difference of several to several tens of volts are applied to the cathode and the gate electrodes 6 and 10, and a direct current voltage of several hundreds to several thousands of volts is applied to the anode electrode 20.

Accordingly, electric fields are formed around the electron emission regions 12 at the pixels where the voltage difference between the cathode and the gate electrodes 6 and 10 exceeds the threshold voltage, and electrons are emitted from these electron emission regions 12. The emitted electrons are attracted by the high voltage applied to the anode electrode 20, are directed toward the second substrate 4 and are collided against the corresponding phosphor layers 16 to thereby emit light.

In the electron emission device according to the first embodiment, since the electron emission regions 12 are placed within the grooves 14 provided at the first substrate 2, the electron emission regions 12 are standing at a plane lower than a plane of the gate electrodes 10. Accordingly, the electrons emitted from the electron emission regions 12 are focused while passing the gate electrodes 10 to thereby minimize the diffusion of the electron beams. Furthermore, the gate electrodes 10 weaken the influence of the anode electric field to the electron emission regions 12, and effectively inhibit the diode type electron emission where electrons are mistakenly emitted from the electron emission regions at the pixels to be off-stated due to the influence of the anode electric field.

Consequently, the screen color purity and the color representation are enhanced, and higher voltage can be applied to the anode electrode 20 to thereby heighten the screen luminance.

A method of fabricating the electron emission device according to the first embodiment of the present invention will be now explained with reference to FIGS. 3A to 3E.

Figure 3A:
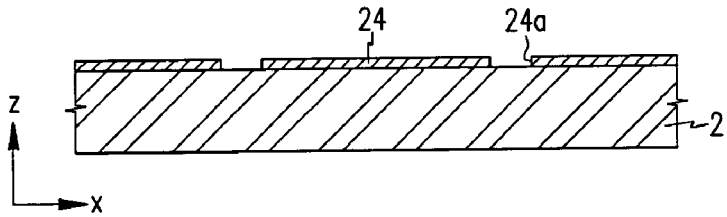
FIGS. 3A, 3B, 3C, 3D, and 3E schematically illustrate the steps of fabricating the electron emission device according to the first embodiment of the present invention.

First, as shown in FIG. 3A, a metallic layer 24 to be used as cathode electrodes is formed on the first substrate 2 (e.g., a transparent substrate). The metallic layer 24 is made with a metallic material, such as a chromium (Cr) material, an aluminum (Al) material and/or a molybdenum (Mo) material. The metallic layer 24 is patterned using a mask pattern (not shown), thereby making opening portions 24*a* to be formed with the grooves 14 of FIG. 3B.

Figure 3B:
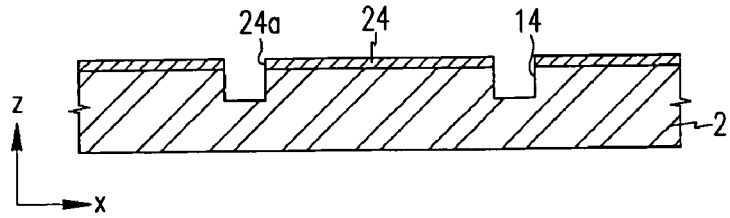

Thereafter, as shown in FIG. 3B, the first substrate 2 is etched using the metallic layer 24 as a mask to thereby form the grooves 14 with a predetermined depth. The etching of the first substrate 2 is made by dipping it in an etching solution containing about 14.3% of fluoric acid for about five minutes such that the resulting grooves 14 have a depth of about 2-3 μm.

Considering that the thickness of the insulating layer and the electron emission region is in the range of about 1-3 μm and about 2-5 μm, respectively, the depth of the groove 14 is established to be about 2-3 μm such that the height difference between the top surface of the electron emission region 12 and the surface of the cathode electrode 6 should be kept to be about 1 μm or less. In one embodiment, the depth of the groove 14 is controlled depending upon the thickness of the insulating layer and/or the electron emission regions 12.

For explanatory convenience, it is illustrated in FIGS. 1 and 2 that the top surface of the electron emission region 12 and the surface of the cathode electrode 6 are placed at the same plane; however, as indicated above, the first embodiment of the present invention is not thereby limited.

Figure 3C:
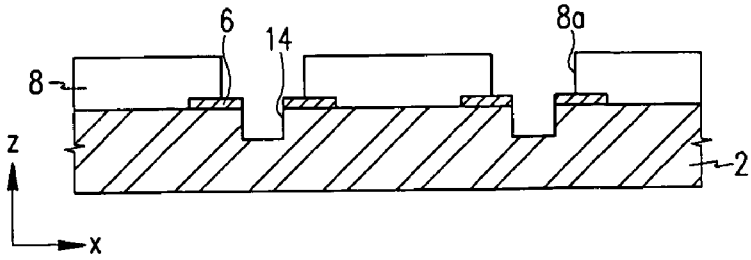

As shown in FIG. 3C, the metallic layer 24 is stripe-patterned to thereby form cathode electrodes 6. $SiO_2$ is deposited onto the entire surface of the first substrate 2 over the cathode electrodes 6 to thereby form an insulating layer 8 with a thickness of about 1-3 μm. Opening portions 8*a* are formed at the insulating layer 8 to thereby expose the grooves 14.

Figure 3D:
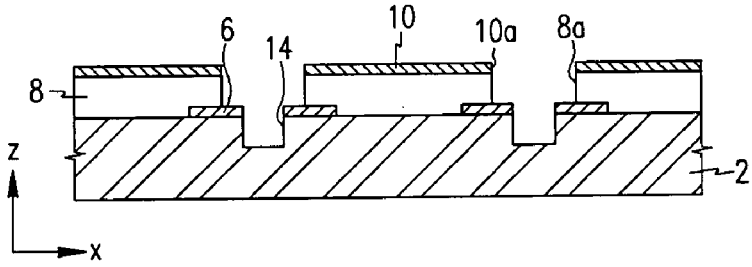

Thereafter, as shown in FIG. 3D, a metallic layer to be used as gate electrodes 10 is deposited onto the insulating layer 8, and patterned to thereby form stripe-patterned gate electrodes 10 proceeding in a direction perpendicular to the cathode electrodes 6 (or perpendicular to an x-axis direction of FIG. 3D). Opening portions 10*a* are also formed at the gate electrodes 10 to thereby expose the grooves 14.

It is explained above that the opening portions 8*a* are formed at the insulating layer 8 after the deposition of the insulating layer 8, and the opening portions 10*a* are formed at the gate electrodes 10 after the formation of the gate electrodes 10, but the opening portions 8*a* and 10*a* of the insulating layer 8 and the gate electrodes 10 may alternatively be formed through only one etching process after the deposition of the insulating layer 8 and the formation of the gate electrodes 10.

Next, the grooves 14 are internally filled with a paste-phased mixture containing an electron emission material and a photosensitive material. The electron emission material can be formed with a carbon nanotube material, a graphite material, a graphite nanofiber material, a diamond material, a diamond-like carbon material, a $C_{60}$ material, and/or a silicon nanowire material.

Figure 3E:
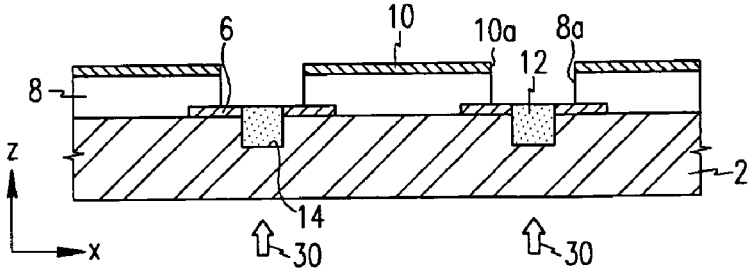

As shown in FIG. 3E, ultraviolet rays 30 (indicated by the arrow) illuminated (or are applied to) the paste-phased mixture filled within the grooves 14 through the backside of the first substrate 2 to selectively harden it, and the non-hardened mixture is removed in the development of the electron emission regions 12, thereby forming the electron emission regions 12 with a thickness of about 2-5 μm.

Finally, spacers 22 are fixed onto the first substrate 2, and phosphor and black layers 16 and 18 are formed on the second substrate 4 together with an anode electrode 20. The first and the second substrates 2 and 4 are attached to each other at their peripheries using a glass frit. The inner space between the first and the second substrates 2 and 4 is exhausted to thereby complete the electron emission device.

Figure 4:
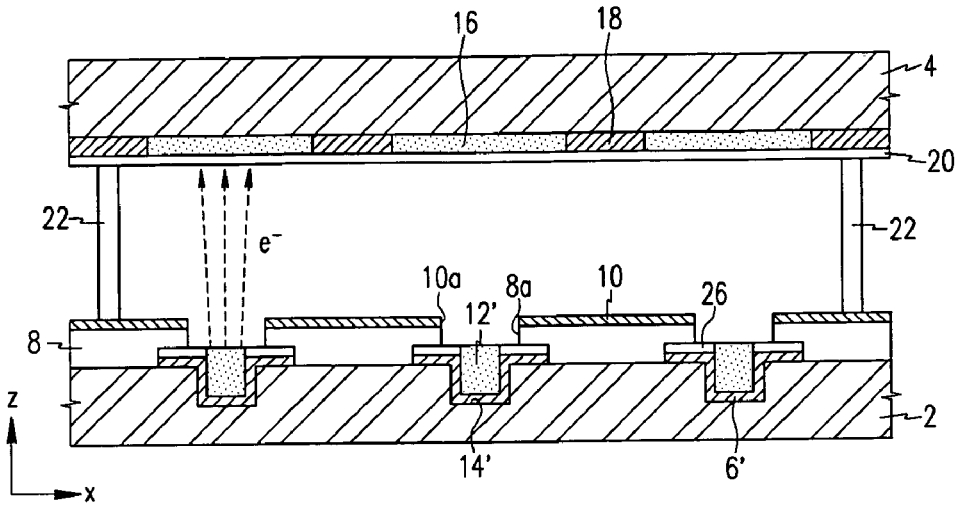
FIG. 4 is a partial sectional view of an electron emission device according to a second embodiment of the present invention.

As shown in FIG. 4, an electron emission device according to a second embodiment of the present invention is provided. The electron emission device of FIG. 4 includes cathode electrodes 6' provided at the first substrate 2. The cathode electrodes 6' of the second embodiment are formed with a transparent conductive material, such as an indium tin oxide (ITO) material, and are also provided on the inner surface of the grooves 14'. Furthermore, a resistance layer 26 is formed on the cathode electrodes 6' to enhance the uniformity in electron emission.

Alternatively, a nontransparent metallic layer may be used instead of the resistance layer 26 to lower the electrical resistance of the cathode electrodes.

In the above described structure according to the second embodiment, since the electron emission regions 12' contact the cathode electrodes 6' at all the sides thereof except for the top side, the contact area between the electron emission regions 12' and the cathode electrodes 6' is increased. Consequently, the contact resistance between the electron emission regions 12' and the cathode electrodes 6' is lowered, thereby reducing the driving voltage, and enhancing the uniformity in electron emission.

A method of fabricating the electron emission device according to the second embodiment of the present invention will be now explained with reference to FIGS. 5A to 5E.

Figure 5A:
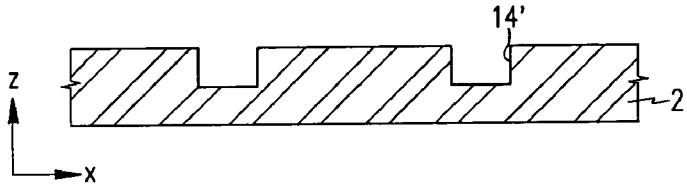
FIGS. 5A, 5B, 5C, 5D, and 5E schematically illustrate the steps of fabricating the electron emission device according to the second embodiment of the present invention.

As shown in FIG. 5A, a mask pattern (not shown) is first used to form grooves 14' at the first substrate 2. The etching of the first substrate 2 is made using substantially the same method as related to the electron emission device according to the first embodiment.

Figure 5B:
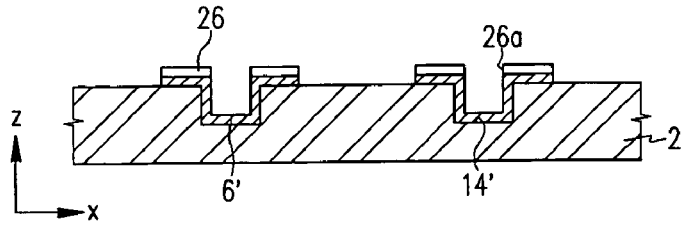

After the removal of the mask pattern, as shown in FIG. 5B, a transparent conductive material, such as ITO, is coated onto the entire top surface of the first substrate 2, and patterned to thereby form the stripe-shaped cathode electrodes 6'. The cathode electrode 6' is also formed on the inner surface of the groove 14'.

A resistance layer 26 or a nontransparent metallic layer (not shown) is formed on the cathode electrodes 6', and patterned to make opening portions 26*a* to be placed with the electron emission regions 12'. In one embodiment, the resistance layer 26 or the nontransparent metallic layer is not formed on the part of the cathode electrode 6' within the groove 14' so that the electron emission regions 12' can be formed using a backside exposure technique (e.g., with ultraviolet rays 30).

Figure 5C:
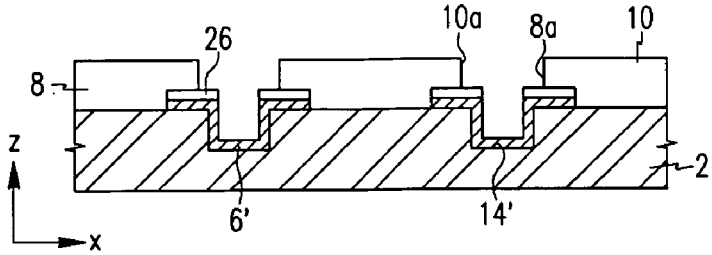
Figure 5D:
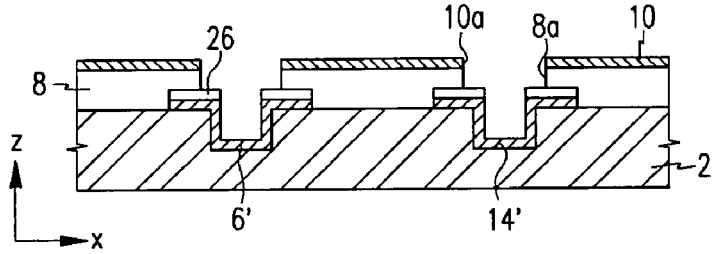

As shown in FIG. 5C, $SiO_2$ is deposited onto the structure of the first substrate 2 to form an insulating layer 8 with a thickness of about 1-3 μm, and the insulating layer 8 is patterned to make opening portions 8*a* thereat. Thereafter, as shown in FIG. 5D, a metallic layer is deposited onto the insulating layer 8, and patterned to thereby form stripe-shaped gate electrodes 10 proceeding in a direction perpendicular to the cathode electrodes 6' (or perpendicular to an x-axis direction of FIG. 5D). Opening portions 10*a* are also formed at the gate electrodes 10 corresponding to the opening portions 8*a* of the insulating layer 8.

Figure 5E:
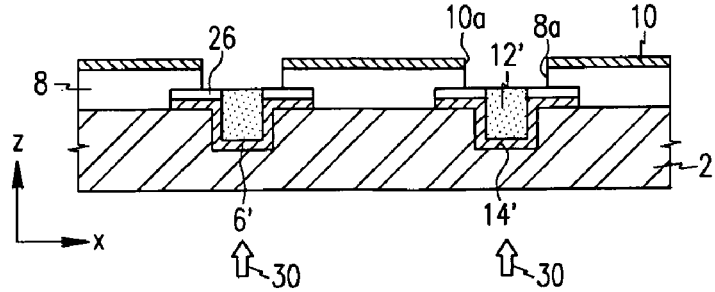

As shown in FIG. 5E, the electron emission regions 12 are then formed using substantially the same method as that related to the first embodiment (e.g., with ultraviolet rays 30).

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a substrate having a plurality of grooves;

a plurality of electron emission regions formed into the grooves;

a plurality of cathode electrodes formed on the substrate such that the cathode electrodes are electrically connected to the electron emission regions;

a plurality of gate electrodes formed over the cathode electrodes; and an insulating layer located between the cathode electrodes and the gate electrodes, wherein the cathode electrodes are on a top surface of the substrate and between the electron emission regions and inner surfaces of the grooves.

2. The electron emission device of claim 1 wherein the cathode electrodes are formed with a metallic material selected from the group consisting of chromium (Cr), aluminum (Al), and molybdenum (Mo) materials.

3. The electron emission device of claim 1 wherein the height difference between a top surface of at least one of the electron emission regions and a top surface of at least one of the cathode electrodes is not more than about 1 μm.

4. The electron emission device of claim 1 wherein the cathode electrodes comprise a transparent conductive material.

5. The electron emission device of claim 1 further comprising a resistance layer placed on a part of a top surface of the cathode electrodes that is not located on an inner surface of the grooves.

6. The electron emission device of claim 1 further comprising a nontransparent metallic layer placed on a top surface of the cathode electrodes that is not located on an inner surface of the grooves.

7. The electron emission device of claim 1 wherein the grooves have a depth of about 2-3 μm.

8. The electron emission device of claim 1 wherein the electron emission regions are formed with a material selected from the group consisting of carbon nanotube, graphite, graphite nanofiber, diamond, diamond-like carbon, $C_{60}$, and silicon nanowire materials.

9. The electron emission device of claim 1 wherein a top surface of each of the electron emission regions is lower than a top surface of each of the gate electrodes.

10. The electron emission device of claim 1 wherein the insulating layer has a thickness of about 1-3 μm.

11. The electron emission device of claim 1 wherein the insulating layer is formed using $SiO_2$.

12. The electron emission device of claim 1 wherein the insulating layer is formed using chemical vapor deposition.

* * * * *